US008590511B2

(12) United States Patent
Negoro et al.

(10) Patent No.: US 8,590,511 B2
(45) Date of Patent: Nov. 26, 2013

(54) INTAKE PASSAGE STRUCTURE FOR INTERNAL COMBUSTION ENGINE, AND ENGINE AND VEHICLE INCORPORATING SAME

(75) Inventors: Masaaki Negoro, Saitama (JP); Toshio Yamamoto, Saitama (JP); Ryuichi Abe, Saitama (JP); Shuichi Ochiai, Saitama (JP); Takanori Osuka, Saitama (JP); Tomokazu Nomura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 626 days.

(21) Appl. No.: 12/730,815

(22) Filed: Mar. 24, 2010

(65) Prior Publication Data

US 2010/0242914 A1 Sep. 30, 2010

(30) Foreign Application Priority Data

Mar. 31, 2009 (JP) ..... 2009-086484

(51) Int. Cl.
*F02M 69/04* (2006.01)
*F02M 35/10* (2006.01)

(52) U.S. Cl.
USPC ..... 123/445; 123/184.56

(58) Field of Classification Search
USPC ..... 123/184.21, 184.22, 184.28, 184.29, 123/184.31, 184.37, 184.38, 184.55, 123/184.56, 306, 308, 445, 193.5
See application file for complete search history.

(56) References Cited

U.S. PATENT DOCUMENTS 4,776,313 A * 10/1988 Freismuth et al. ..... 123/470
4,779,594 A 10/1988 Oda et al.
5,207,210 A 5/1993 Yamagata et al.
5,335,634 A 8/1994 Hashimoto et al.
5,806,482 A * 9/1998 Igarashi et al. ..... 123/259
5,913,298 A * 6/1999 Yoshikawa ..... 123/306
5,957,112 A * 9/1999 Takahashi et al. ..... 123/469
6,035,822 A * 3/2000 Suzuki et al. ..... 123/276
6,055,958 A 5/2000 Aoyama et al.
6,082,336 A * 7/2000 Takahashi et al. ..... 123/508
6,148,794 A * 11/2000 Tsuzuku et al. ..... 123/406.5
6,202,626 B1 * 3/2001 Ito et al. ..... 123/336
6,308,695 B1 * 10/2001 Watanabe et al. ..... 123/572
6,510,823 B2 * 1/2003 Hirano et al. ..... 123/54.4
6,644,260 B2 * 11/2003 Tsukii et al. ..... 123/184.42
6,752,114 B2 * 6/2004 Ochiai et al. ..... 123/184.21
7,237,534 B2 7/2007 Imamura (Continued)

FOREIGN PATENT DOCUMENTS

DE 37 13 628 a1 11/1987
DE 4 208 725 A1 10/1992

(Continued)

*Primary Examiner* — John T. Kwon
*Assistant Examiner* — Johnny Hoang
(74) *Attorney, Agent, or Firm* — Carrier Blackman & Associates, P.C.; William D. Blackman; Joseph P. Carrier

(57) ABSTRACT

An internal combustion engine includes an intake passage structure. The engine is configured such that a cylinder head is formed integrally with an intake manifold portion. A cylinder central axis is oriented parallel to an extending direction of an intake passage, when viewed in a side view. An injector is arranged such that it does not interfere with peripheral components, including the intake passage and a throttle body. The injector is disposed in the intake manifold portion such that a leading end thereof is oriented towards the intake valve of the cylinder head. The intake passage on the upstream side of an injector attachment position is offset from the injector in a width-direction of the internal combustion engine.

20 Claims, 10 Drawing Sheets

(56) References Cited

U.S. PATENT DOCUMENTS

| | | | | |
|---|---|---|---|---|
| 7,302,934 | B2 | 12/2007 | Ishii et al. | |
| 2002/0023599 | A1* | 2/2002 | Laimbock | 123/59.6 |
| 2002/0043254 | A1* | 4/2002 | Iizuka et al. | 123/568.13 |
| 2004/0226536 | A1* | 11/2004 | Sakai et al. | 123/308 |
| 2004/0237925 | A1* | 12/2004 | Kudo et al. | 123/184.61 |
| 2007/0193554 | A1* | 8/2007 | Yamasaki et al. | 123/198 E |
| 2008/0072863 | A1* | 3/2008 | Egawa et al. | 123/184.57 |

FOREIGN PATENT DOCUMENTS

| | | | |
|---|---|---|---|
| EP | 0 675 274 | A1 | 10/1995 |
| EP | 1 063 413 | A2 | 12/2000 |
| EP | 2 149 696 | A2 | 2/2010 |
| FR | 2 663 686 | A1 | 12/1991 |
| JP | 62-253956 | A | 11/1987 |
| JP | 7-063034 | A | 3/1995 |
| JP | 10 103196 | A | 4/1998 |
| JP | 11-082157 | | 3/1999 |
| JP | 2004-052708 | A | 2/2004 |
| JP | 2006-057566 | A | 3/2006 |
| JP | 2007-211627 | A | 8/2007 |
| JP | 2010-223210 | A | 10/2010 |
| WO | 2005/098231 | A1 | 10/2005 |

* cited by examiner

INTAKE PASSAGE STRUCTURE FOR INTERNAL COMBUSTION ENGINE, AND ENGINE AND VEHICLE INCORPORATING SAME

CROSS-REFERENCE TO RELATED APPLICATIONS

The present invention claims priority under 35 USC 119 based on Japanese patent application No. 2009-086484, filed on Mar. 31, 2009. The entire subject matter of this priority document, including specification claims and drawings thereof, is incorporated by reference herein.

BACKGROUND OF THE INVENTION

1. Field of the Invention

The present invention relates to an intake passage structure for an internal combustion engine, and to an engine and a vehicle incorporating the same. More particularly, the present invention relates to an intake passage structure, in which an injector is oriented towards an intake valve of a cylinder head of an engine such that the injector does not interfere with an intake passage and a throttle body of the intake passage structure, and to an engine and a vehicle incorporating the same.

2. Description of the Background Art

There is a known internal combustion engine, in which an intake manifold is formed integrally with a cylinder head, and when viewed in a side view, an intake passage formed continuous with the intake manifold is extended parallel to a cylinder central axis. An example of such internal combustion engine is disclosed in the Japanese Patent Laid-Open No. Hei 11-82157.

In an internal combustion engine equipped with an injector (fuel injection valve) for supplying fuel into a combustion chamber, it is necessary that the injector is arranged with a leading end thereof oriented towards a direction of an intake valve. Therefore, in many cases, the injector is usually provided in the intake manifold. In an internal combustion engine configured such that the intake passage extends parallel to the cylinder central axis, as in the conventional art, the injector may be attached to the intake passage while keeping such an orientation of the injector.

In such cases, the injector is inevitably tilted to come close to the intake passage. This leads to a problem of the injector interfering with the intake passage, or with a throttle body and a connection pipe connected to the intake passage. Accordingly, it is necessary that the injector is disposed at an appropriate location in the engine while preventing interference thereof with such peripheral components.

The present invention has been made to overcome such drawbacks of existing disposition of an injector in an internal combustion engine. Accordingly, it is one of the objects of the present invention to dispose an injector so that a leading end thereof is oriented towards a direction of an intake valve while preventing interference with peripheral components.

SUMMARY OF THE INVENTION

In order to achieve the above objects, the present invention according to a first aspect thereof provides an intake passage structure of an internal combustion engine. The engine is configured such that a cylinder head is formed integrally with an intake manifold portion, and when viewed in a side view, a cylinder central axis is oriented parallel to an extending direction of an intake passage. The present invention according to the first aspect thereof is characterized in that an injector is disposed at the intake manifold portion so as to be oriented toward an intake valve of the cylinder head, and that in a width-direction of the internal combustion engine, an upstream side of the intake passage is offset relative to an injector attachment portion formed in the intake manifold portion.

The present invention according to a second aspect thereof, in addition to the first aspect, is characterized in that the internal combustion engine is a multi-cylinder internal combustion engine. The multi-cylinder combustion engine includes a plurality of cylinders arranged in parallel; a plurality of the intake manifold portions each connected to a corresponding one of the cylinders; a plurality of injectors, each disposed at a corresponding one of the intake manifold portions; and the intake manifold portions integrated between the plurality of injectors on the upstream side of the intake manifold portions.

The present invention according to a third aspect thereof, in addition to the second aspect, is characterized in that the plurality of intake manifold portions are integrated on the upstream side thereof thereby forming a single intake passage, and that a single throttle body is disposed in the single intake passage.

The present invention according to a fourth aspect thereof, in addition to one of the second and third aspects, is characterized in that the internal combustion engine includes a drive mechanism for driving intake valves and exhaust valves on the cylinder head, and that the drive mechanism is disposed at an end of a row of the cylinders.

The present invention according to a fifth aspect thereof, in addition to one of the second and third aspects, is characterized in that the multi-cylinder internal combustion engine is arranged such that each of the cylinders is provided with a plurality of intake valves, and a branch passage of the intake passage downstream of the intake manifold portion is connected with each of the intake valves disposed inside the cylinder head.

The present invention according to a sixth aspect thereof, in addition to the fifth aspects, is characterized in that the multi-cylinder internal combustion engine is arranged such that each of the cylinders is provided with a plurality of exhaust valves, and an arrangement-interval between a plurality of the intake valves is less than that between an arrangement interval between the exhaust valves. That is, a distance between the intake valves of a cylinder is less than a distance between the exhaust valves of the same cylinder.

The present invention according to a seventh aspect thereof, in addition to one of the fifth and sixth aspects, is characterized in that, when viewed in a side view of the internal combustion engine, a portion of the intake passage from an intake passage inlet of the intake manifold portion to the branch passage is formed to be substantially linearly inclined.

EFFECTS OF THE INVENTION

According to the first aspect of the present invention, in the internal combustion engine in which the cylinder central axis is oriented substantially parallel to the extending direction of the intake passage, the injector and the intake passage are arranged offset from each other in the width direction. Thus, the injector is disposed at an appropriate position while preventing interference thereof with the intake passage and/or the throttle body.

According to the second aspect of the present invention, the plurality of intake passages in the internal combustion engine having multiple cylinders arranged parallel are brought on the upstream side into close to each other, and are joined into a single one. Thus, the intake system can be downsized without broadening widthwise.

According to the third aspect of the present invention, since the single throttle body is disposed at the joined portion of the branch passages of the intake passage, the number of components and cost can be reduced compared with the case where a plurality of throttle valves and throttle bodies are arranged in a conventional motorcycle.

According to the fourth aspect of the present invention, since the drive mechanism is disposed at the end of the cylinder-row, the intake passages continuous with the cylinder can be brought into close to each other for having a narrower width therebetween, compared with the internal combustion engine where the drive mechanism is disposed between the cylinders.

According to the fifth aspect of the present invention, the branch passage continuous with the intake valve is formed on the downstream side of the intake manifold portion and inside the cylinder head. Thus, the branch passage continuous with the intake valve can easily be designed inside of the cylinder head without being influenced by the shape of the intake manifold portion.

According to the sixth aspect of the present invention, the interval between the intake valves is less than the interval between the exhaust valves of the cylinder of the engine. Thus, the intake passage including the overall intake manifold portion can be formed compactly, which contributes to the downsizing of the internal combustion engine.

According to the seventh aspect of the present invention, since the intake passage is formed to be substantially linearly inclined, the resistance of the intake passage can be suppressed to increase the output of the internal combustion engine.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

An embodiment of the present invention will now be described, with reference to the drawings. Throughout this description, relative terms like "upper", "lower", "above", "below", "front", "back", and the like are used in reference to a vantage point of an operator of the vehicle, seated on the driver's seat and facing forward. It should be understood that these terms are used for purposes of illustration, and are not intended to limit the invention.

Figure 1:
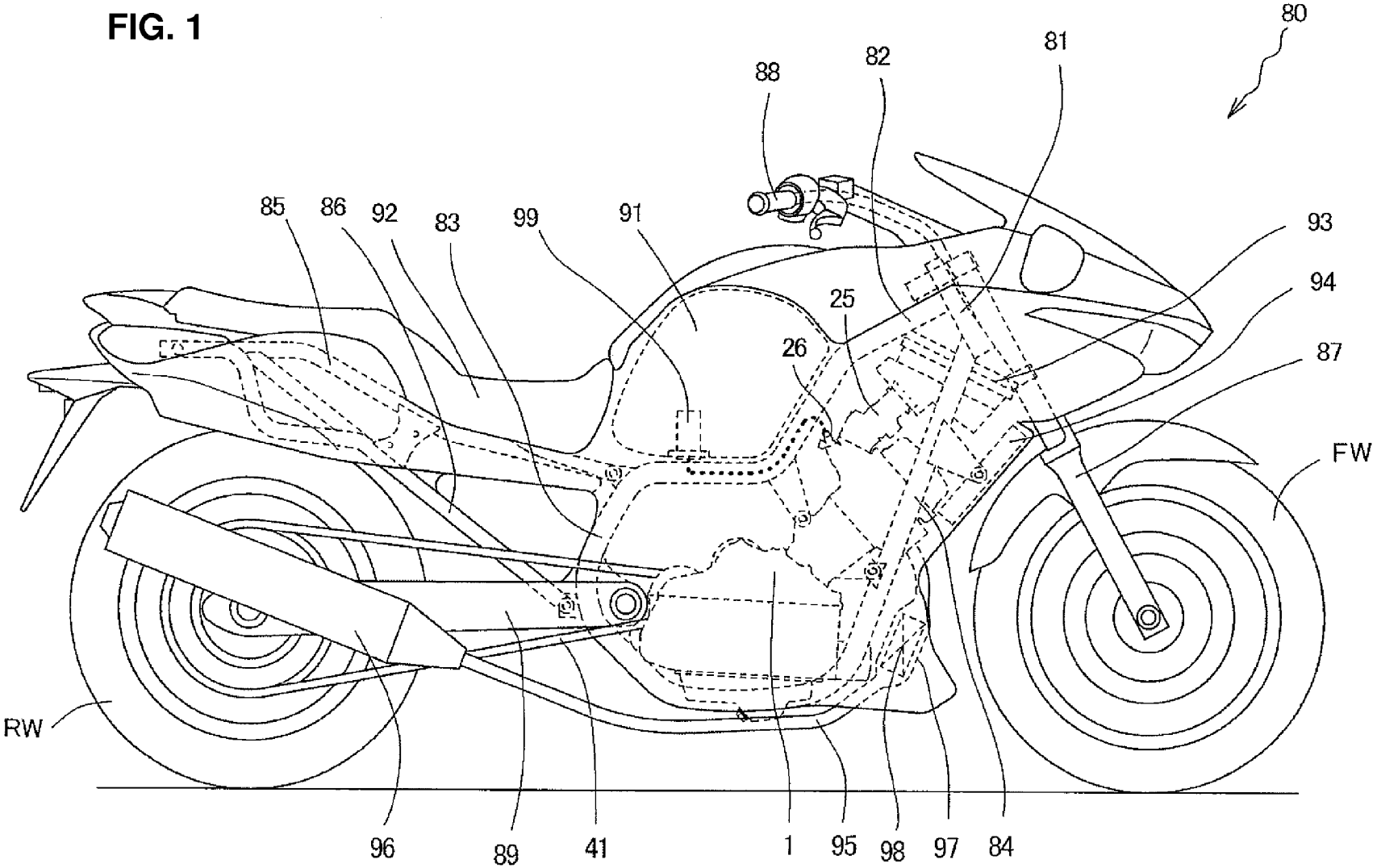
FIG. 1 is a lateral view of a motorcycle according to an embodiment of the present invention.

FIG. 1 is a lateral view of a motorcycle 80 according to an illustrative embodiment of the present invention. As shown in FIG. 1, a body frame of the motorcycle 80 includes a head pipe 81; main frames 82 extending obliquely rearward from the head pipe 81; and center frames 83 extending downward from the rear ends of the main frames 82.

The body frame further includes down frames 84 extending downward from the head pipe 81; seat stays 85 extending rearward from upper portions of the center frames 83; and mid frames 86 each spanned between a rear portion of the center frame 83 and a rear portion of the seat stay 85. A front fork 87 supporting a front wheel FW is steerably supported by the head pipe 81. A steering handlebar 88 is coupled to an upper portion of the front fork 87. A rear fork 89 supporting a rear wheel RW is swingably supported vertically by a rear portion of the center frame 83.

The engine 1 is a two-cylinder internal combustion engine. The engine 1 is supported by the main frames 82, the center frames 83 and the down frames 84. The power of the internal combustion engine 1 is transmitted to the rear wheel RW via a transmission unit built in the engine 1, and via a rear wheel drive chain 41. A fuel tank 91 is mounted on the left and right main frames 82 and center frames 83 so as to be located at a position above the internal combustion engine 1. A tandem seat 92 for driver and pillion passenger is mounted on the seat stays 85.

A throttle body 25 formed continuously with an intake port of the internal combustion engine 1 is coupled to an air cleaner 93. A radiator 94 is disposed frontwardly of the internal combustion engine 1. An exhaust pipe 95 extending from a front surface of the internal combustion engine 1 extends downwardly of the internal combustion engine 1. The exhaust pipe 95 is connected with a muffler 96 located at a rear portion of the vehicle body. A catalyst case 97 of the exhaust pipe 95 is provided at a position forwardly of the internal combustion engine. The catalyst case 97 receives a catalyst 98 therein. Fuel from the fuel tank 91 is supplied to an injector (fuel injection valve) 26 via a fuel pump 99, and then to the internal combustion engine 1.

Figure 2:
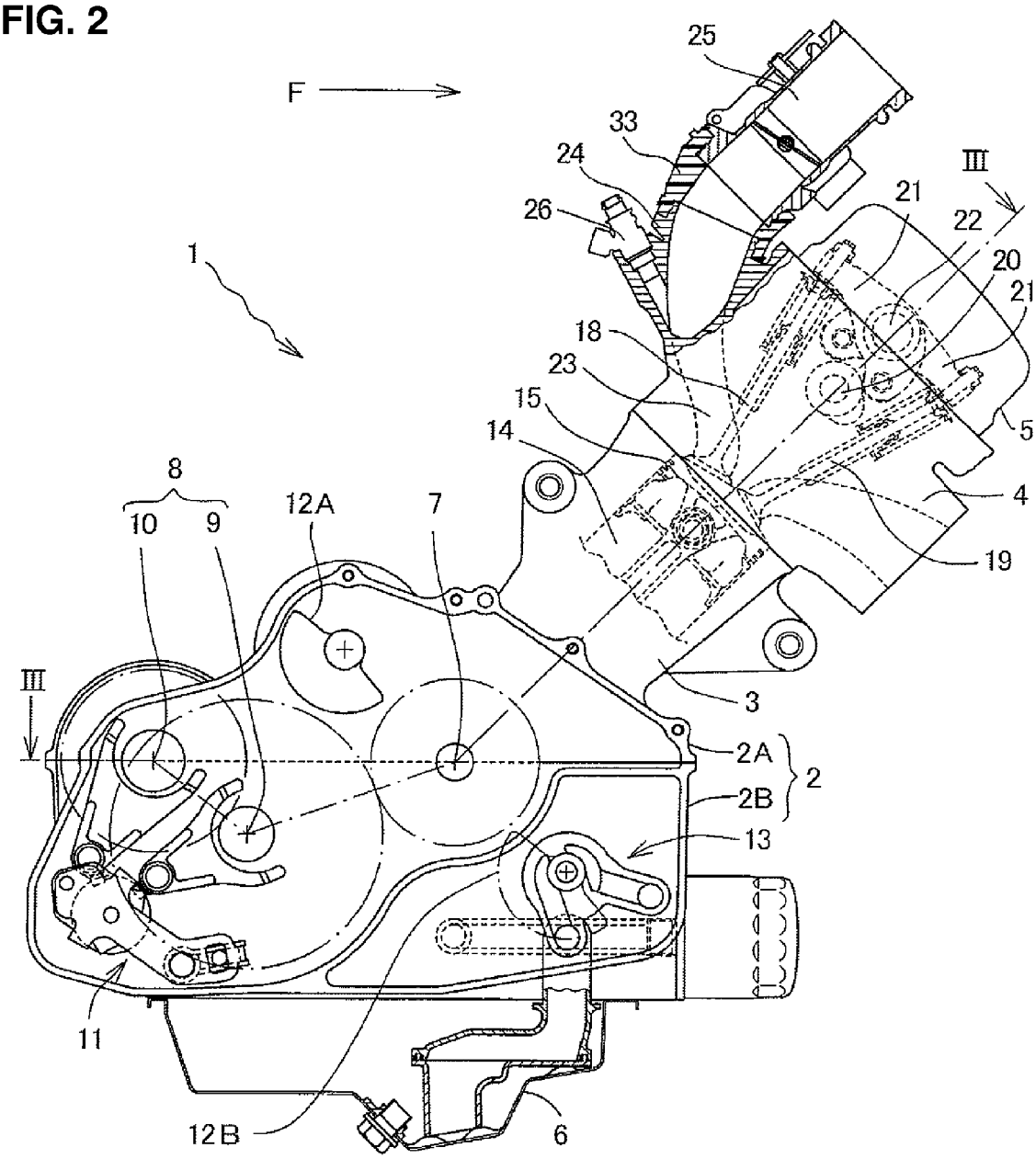
FIG. 2 is a longitudinal cross-sectional view of the above-mentioned internal combustion engine as viewed from the right.

FIG. 2 is a longitudinal, a right side cross-sectional view of the two-cylinder internal combustion engine. Arrow F indicates the front of the internal combustion engine 1 corresponding to the front of the vehicle encountered when the internal combustion engine 1 is mounted on the vehicle.

The internal combustion engine 1 is a transmission-integral type internal combustion engine. A shell of the engine 1 includes a vertically-halved crankcase 2 having an upper crankcase 2A and a lower crankcase 2B, a cylinder block 3 formed integrally with the upper crankcase 2A, a cylinder head 4, a cylinder head cover 5, and an oil pan 6 attached to a lower portion of the lower crankcase 2B.

A crankshaft 7 and a counter shaft 10 of the constant-mesh type gear transmission 8 are disposed at a division surface between the upper and lower crankcases 2A, 2B. A main shaft 9 of the transmission 8 is disposed below and between both the crankshaft 7 and the counter shaft 10. A gear change mechanism 11 is disposed at a position located below the counter shaft 10, and rearwardly of the main shaft 9.

An upper balancer 12A is disposed obliquely rearwardly of and above the crankshaft 7. A lower balancer 12B is disposed obliquely forward of and below the crankshaft 7 at a position symmetrical to the upper balancer 12A. The balancers 12A, 12B are directly driven by the crankshaft 7. An oil pump 13 is mounted to the shaft end of the lower balancer 12B.

Figure 8:
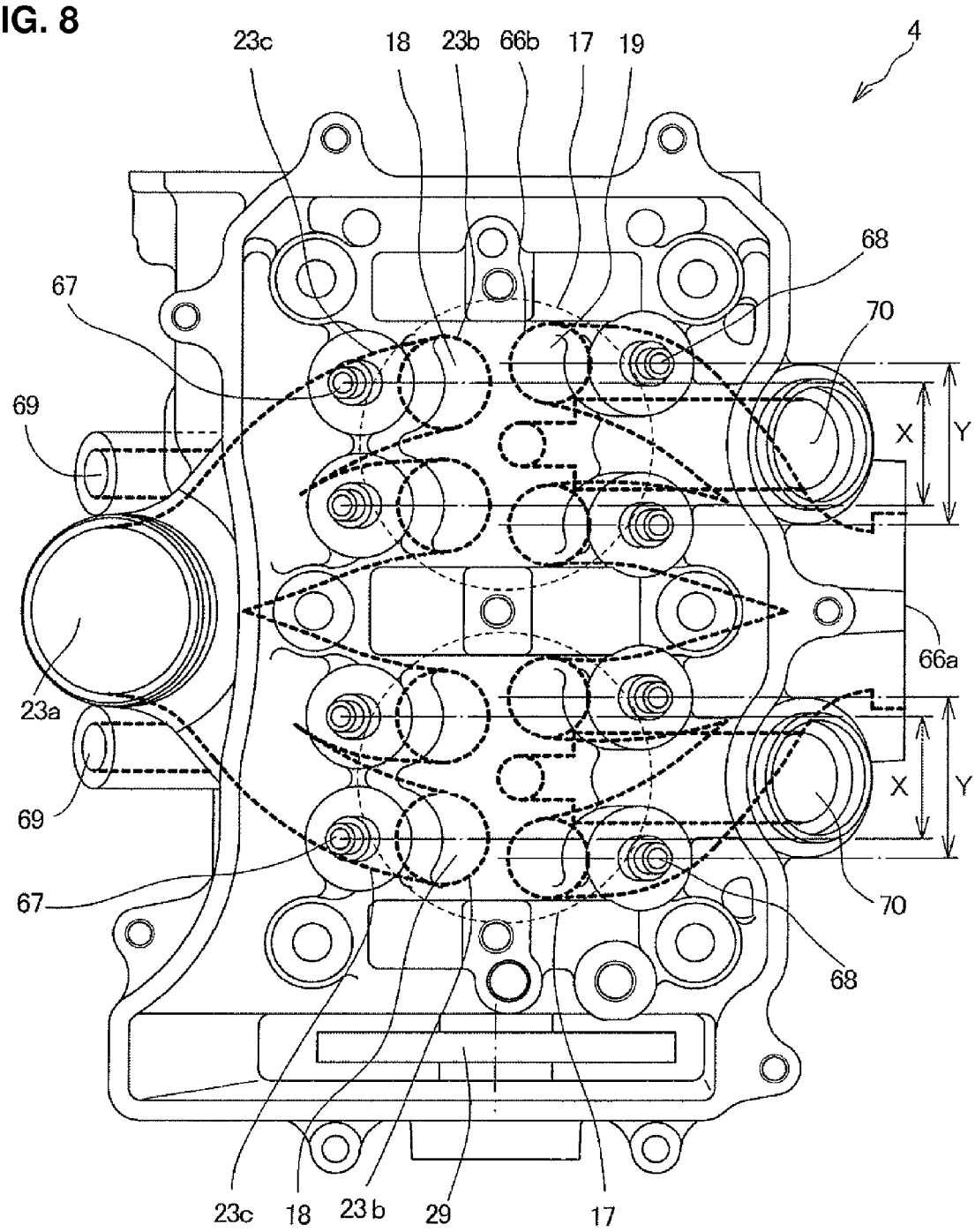
FIG. 8 is a plan view of the cylinder head.

The cylinder block 3 includes two cylinders 14. A piston 15 is slidably fitted into each of the cylinders 14. Intake valves 18, exhaust valves 19, a camshaft 20, and a rocker shaft 22 provided with rocker arms 21 are provided on the cylinder head 4. Respective branch intake passages 23*c* of the two cylinders 14 are assembled into a single intake passage 23 via an intake manifold portion 24 and connected to a single throttle body 25 (FIG. 8). The intake manifold portion 24 is equipped with two injectors (fuel injection valves) 26 for respective corresponding cylinders. The throttle body 25 is mounted to the intake manifold portion 24 via an insulator 33.

Figure 3:
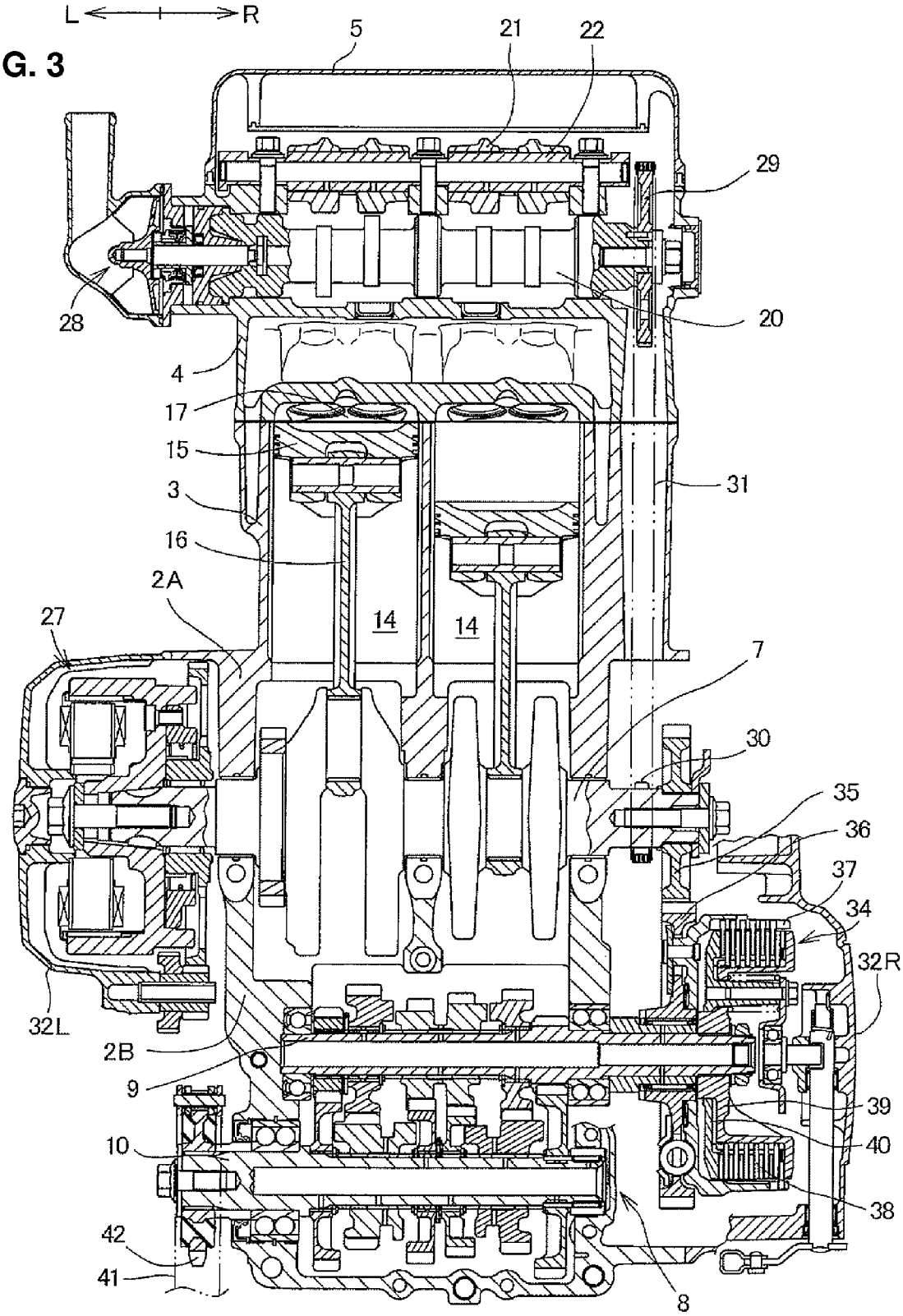
FIG. 3 is a cross-sectional view taken along line III-III of FIG. 2.

FIG. 3 is a cross-sectional view taken along line III-III of FIG. 2, showing a horizontal-surface development view of the internal combustion engine 1 including the camshaft 20, the cylinders 14, the crankshaft 7, the main shaft 9 and the counter shaft 10. In FIG. 3, arrows L and R indicate the left and right, respectively, of the internal combustion engine 1. Corresponding, respectively, to the left and right of the vehicle encountered when the engine 1 is mounted on the vehicle.

The shell of the engine 1 includes the lower crankcase 2B, the upper crankcase 2A, the cylinder block 3 integral with the upper crankcase 2A, the cylinder head 4, the cylinder head cover 5, the left crankcase cover 32L and the right crankcase cover 32R, starting from the underside. An AC generator 27 is mounted on the left end of the crankshaft 7 and covered by the left crankcase cover 32L.

The cylinder block 3 integral with the upper crankcase 2A is provided with the two cylinders 14. The pistons 15 are slidably fitted into the respective cylinders 14, and are connected to the crankshaft 7 via corresponding connecting rods 16. A combustion chamber 17 is defined between the upper surface of the piston 15 and the lower surface of the cylinder head 4.

The single camshaft 20 is provided on the cylinder head 4. The single rocker shaft 22 provided with the rocker arm 21 is provided at a position located above the camshaft 20. A water pump 28 is attached to the left end portion of the camshaft 20 for circulating cooling water. A camshaft driven sprocket 29 is attached to the right end of the camshaft 20, and is drivingly rotated via a cam chain 31 spanned between the camshaft driven sprocket 29 and a camshaft drive sprocket 30 attached to the crankshaft 7.

The main shaft 8 and counter shaft 10 of the transmission 8 are provided parallel to the crankshaft 7. A multi-disk clutch 34 is mounted to the right end of the main shaft 9 and covered by the right crank case cover 32R. A primary driven gear 36 provided on the main shaft 9 so as to be capable of idle rotation is drivingly rotated by a primary drive gear 35 located at the right end of the crankshaft 7. This rotates a clutch outer 37 connected to the primary driven gear 36 for rotating a clutch inner 39 via a plurality of friction plate 38. This drivingly rotates the main shaft 9 having the clutch inner 39 is secured.

In this way, the rotation of the crankshaft 7 is transmitted to the main shaft 9. Clutch operation releases the pressing force of the pressurizing plate 40 of the clutch 34 to reduce the friction force of the friction plates 38, which disengages the clutch 34. The constant-mesh type gear transmission 8 is provided on the main shaft 9 and the counter shaft 10. Incidentally, a rear wheel drive sprocket 42 engaged with a rear wheel drive chain 41 for driving the vehicle is attached to the left end of the counter shaft 10.

Figure 4:
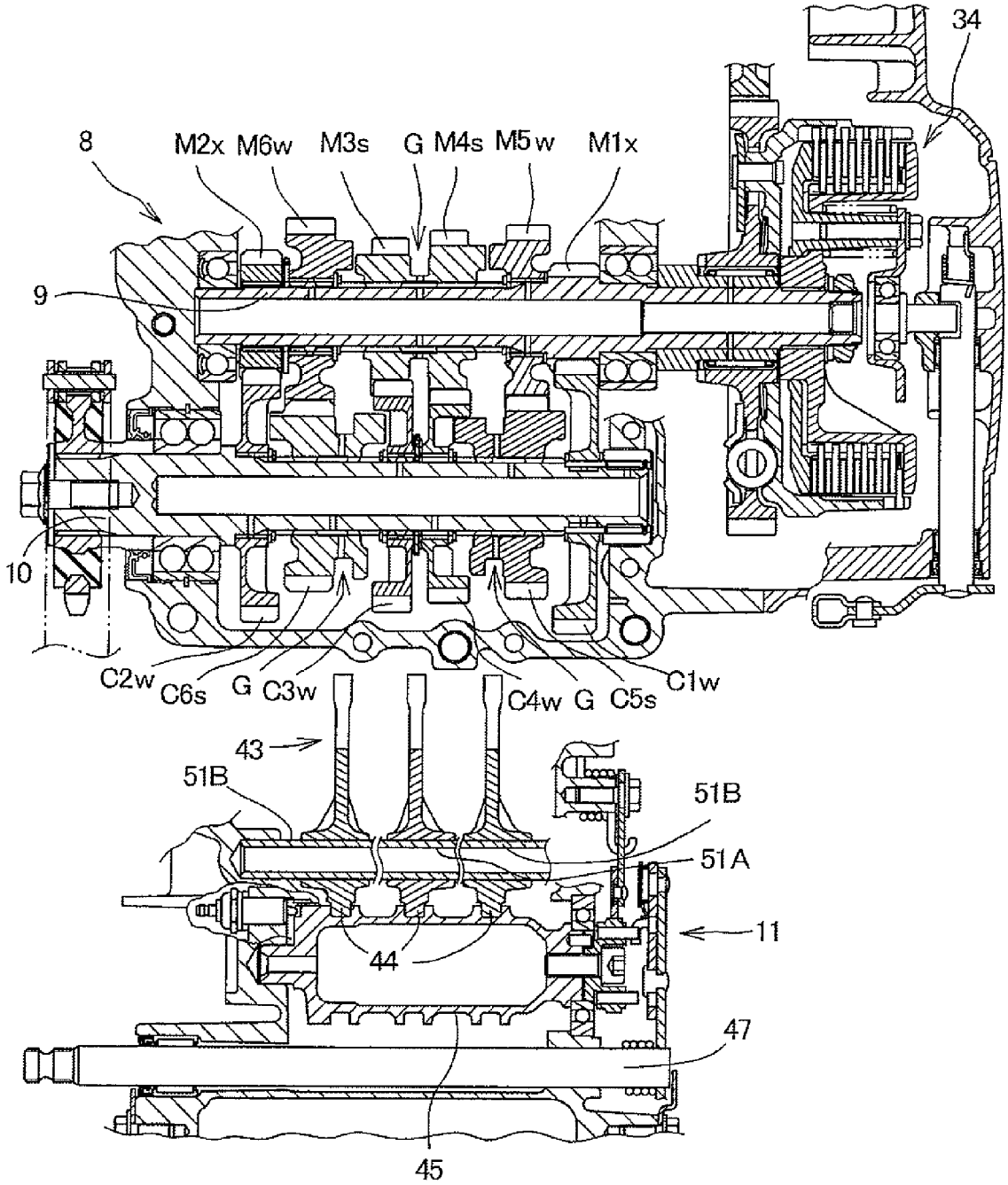
FIG. 4 is a cross-sectional detail view, partially cut away, of a constant-mesh type gear transmission and a gear change mechanism.

FIG. 4 is a configurational view of the constant-mesh type gear transmission 8 and the gear change mechanism 11. Six gears of the constant-mesh type gear transmission 8 are provided on each of the main shaft 9 and the counter shaft 10. Six gears M1 to M6 are provided on the main shaft 9. Six gears C1 to C6 constantly meshing with the respective gears M1 to M6 are provided on the counter shaft 10.

Symbol "M" denotes main shaft-belonging gears, "C" denotes counter shaft-belonging gears, and suffixes 1 to 6 denote gears for determining the reduction ratios of first- to sixth-speeds. Subscript "x" denotes fixed gears being integral with or fixed to the shaft through spline. Subscript "w" denotes idle gears located at given positions to be capable of rotation relative to the shaft. Subscript "s" denotes slide gears held by the shaft through spline and being axially movable with rotation restricted with respect to the shaft.

The other side gear meshingly engaged with the fixed gear (subscript "x") and with the slide gear (subscript "s") is the idle gear (subscript "w"). The idle gear cannot fulfill a function as a gear alone. To fulfill the function as a gear, the idle gear needs to be secured to the shaft by the adjacent slide gear (subscript "s"). The slide gear (subscript "s") is provided with an engaging groove G adapted to receive a shift fork 43 engaged therewith to axially drive the gear. The two slide gears of the main shaft 9 is formed into a single piece and have the engaging groove G formed at the central portion therebetween. The shift fork 43 is driven by the gear change mechanism 11.

FIG. 4 (see a lower portion thereof) illustrates the cross-section of the gear change mechanism 11 for driving the slide gears (subscript "s"). Three shift forks 43 supported by two shift fork support shafts 51A, 51B, a shift drum 45 engaged with pins 44 of the shift forks 43, a change spindle 47, etc. A central shift fork of the three shift forks 43 is engaged with the slide gears of the main shaft 9 and the shift forks on both ends are engaged with the slide gear of the counter shaft 10.

Figure 5:
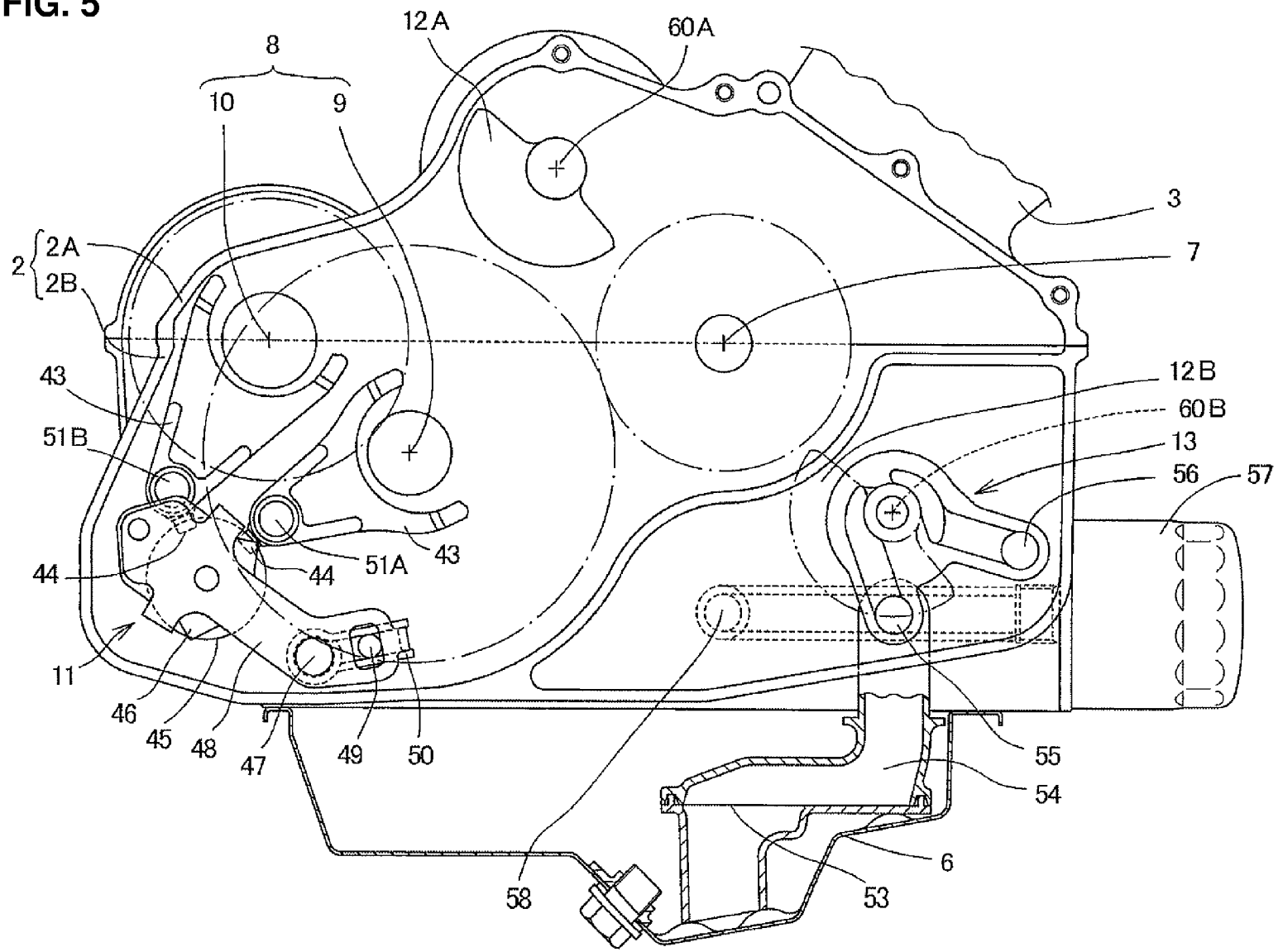
FIG. 5 is an enlarged view of an inside portion of a crankcase.

FIG. 5 is an enlarged view illustrating the inside of the crankcase 2. The gear change mechanism 11 includes the shift drum 45, a star-shaped plate 46, a change spindle 47, a change arm 48 welded to an end of the change spindle 47, a restriction bolt 49, and a change arm return spring 50 and the like. The change spindle 47 is operatively turned to move the change arm 48, which intermittently turns the star-shaped plate 46 and the shift drum 45. In response to the operation of the change spindle 47, the shift fork 43 is moved via a pin 44 to operatively shift up or down the transmission 8.

An oil intake pipe 54 provided with an oil strainer 53 is arranged in the oil pan 6. The oil intake pipe has an upper end joined to an oil intake port 55 of the oil pump 13. A rotating shaft of the oil pump 13 is directly connected to a rotating shaft 60B of the lower balancer 12B. A discharge port 56 of the oil pump 13 is continuous with an oil filter 57. The purified oil is supplied via a main gallery 58 for lubricating portions of the internal combustion engine 1.

Figure 6:
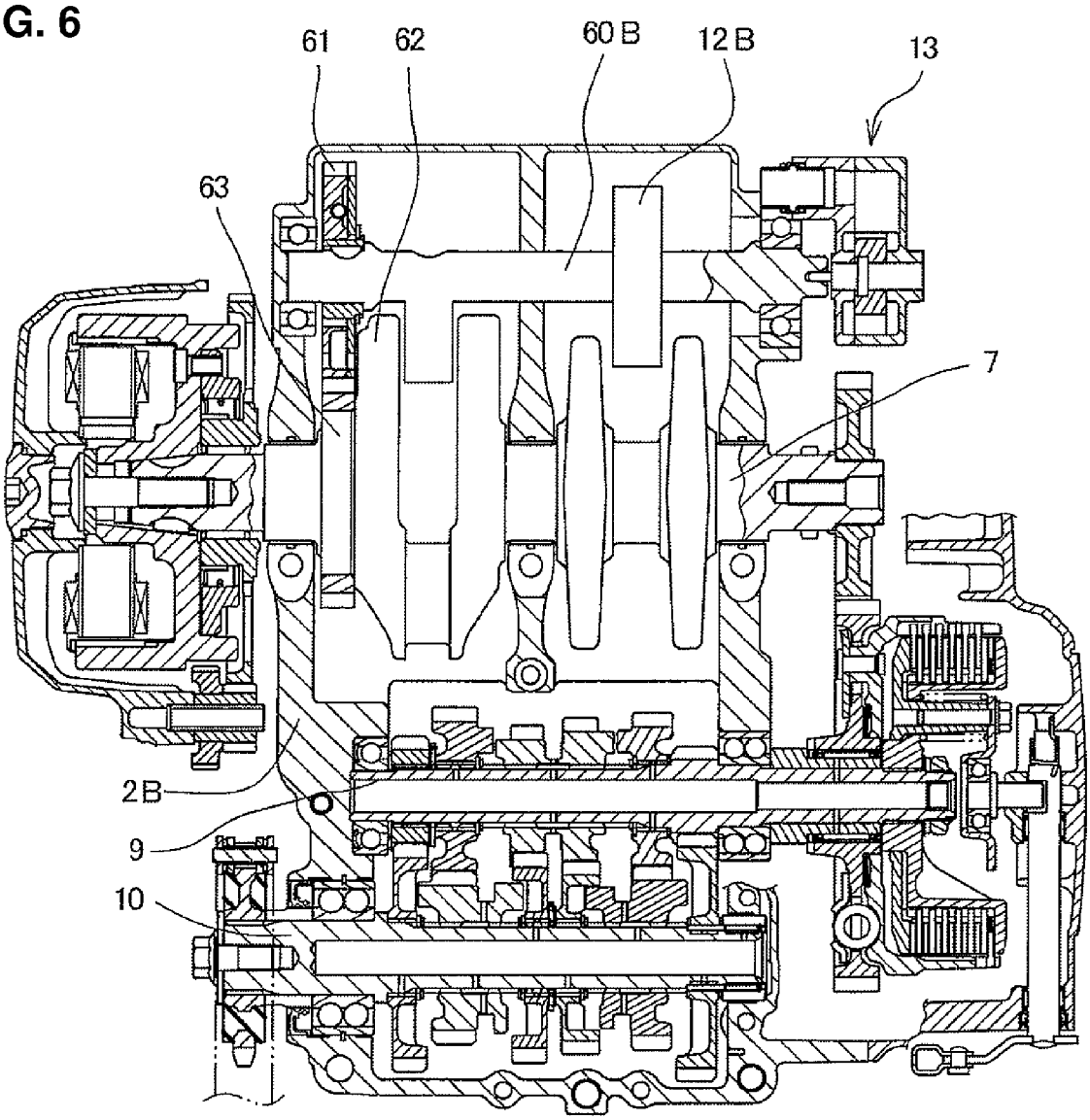
FIG. 6 is a development view of a cross-section including a lower balancer shaft and a crankshaft.

FIG. 6 is a development view of a cross-section including the rotating shaft 60B of the lower balancer 12B, the crankshaft 7, the main shaft 9 and the counter shaft 10. FIG. 6, in particular, illustrates the relationship between the lower balancer 12B and the oil pump 13. The configuration of the upper balancer 12A and an upper balancer shaft 60A is similar to that of the lower balancer 12B and lower balancer shaft 60B.

A balancer driven gear 61 provided on the left end of the lower balancer shaft 60B is engaged with a balancer drive gear 63 provided adjacently to a left crank web 62 of the crankshaft 7 and having the same diameter as that of the balancer drive gear 63.

In addition, the lower balancer shaft 60B is driven by the crankshaft 7. Also, the upper balancer shaft 60A is provided with a similar balancer driven gear 61, which is driven by the crankshaft 7. The oil pump 13 is provided at the right end of the lower balancer shaft 60B. The oil pump 13 is directly connected to and driven by the balancer shaft 60B.

Figure 7:
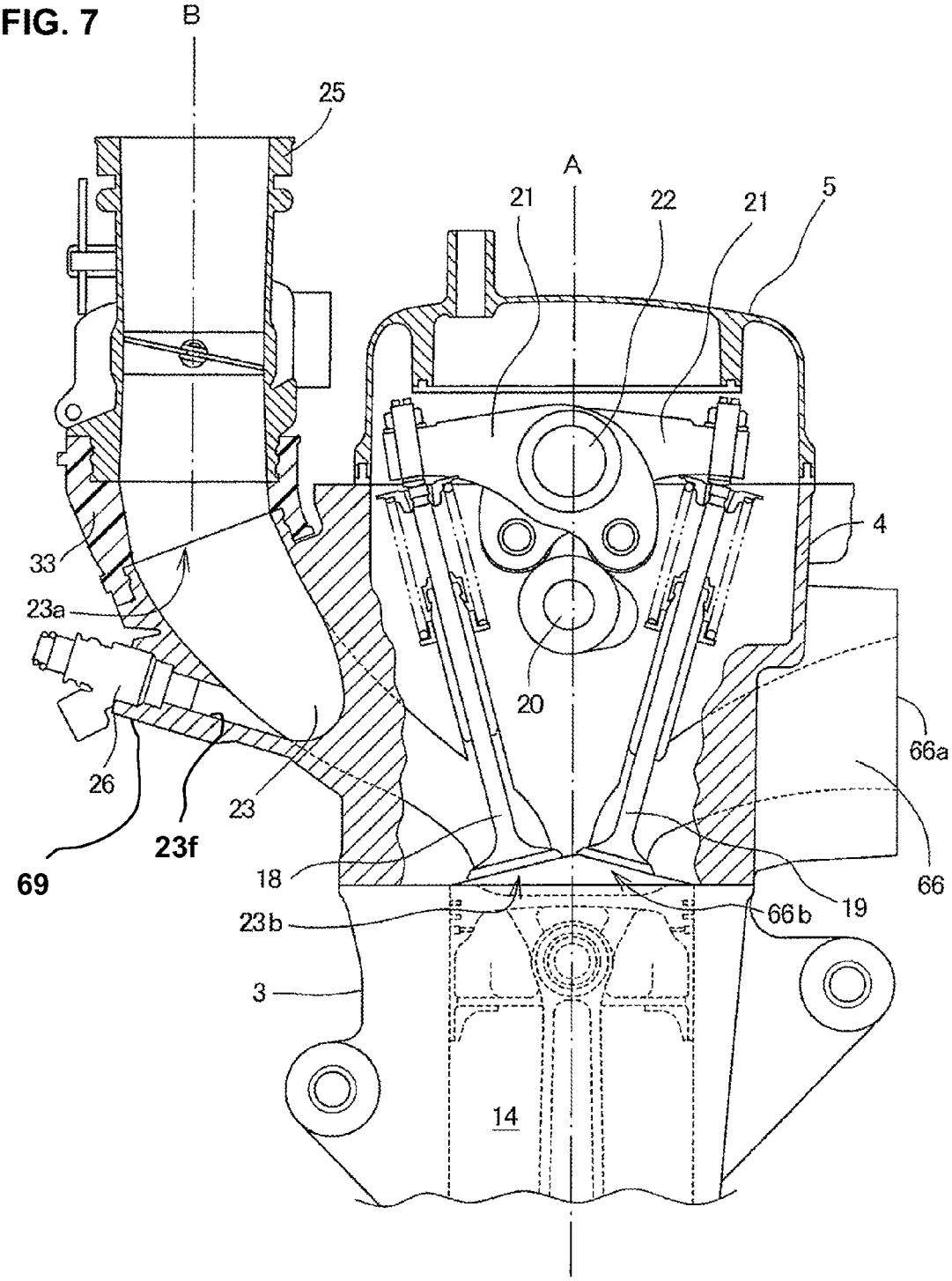
FIG. 7 is a longitudinal cross-sectional view of a cylinder head.

FIG. 7 is a longitudinal cross-sectional view of the cylinder head 4. A cylinder central axis A is generally parallel to a centerline B of the throttle body extending in a direction of the intake passage 23. The throttle body 25 is installed via an insulator 33 placed between the throttle body and the intake manifold portion 24 of the cylinder head 4. As shown in FIG. 7, the intake manifold portion 24 has a fuel delivery passage 23*f* formed therein, extending between an injector attachment portion 69 of the cylinder head 4 and the intake passage 23. The fuel delivery passage 23*f* joins the intake passage 23 at an area thereof which is spaced away from the intake valve 18, as shown. The injecting direction of the injector 26 generally faces the intake valve 18.

FIG. 8 is a plan view of the cylinder head 4. The combustion chambers 17 are provided under the cylinder head 4 at two positions. The circles indicated with broken lines in the FIG. 8 are outer edges of the combustion chambers 17. A single intake passage inlet 23*a* is provided at the rear portion of the cylinder head 4. The intake passage 23 is branched along the flow of intake air into four directions. Intake passage internal end openings 23*b* of the intake passage 23 communicate at two positions with each of the two combustion chambers 17.

In a front portion of the cylinder head 4, exhaust passage internal end openings 66*b* of an exhaust passage 66 are provided at two positions for each of the two combustion chambers 17 and are formed along the flow of exhaust gas into a single one, i.e., into a single exhaust passage outlet 66*a*. In order to operate (i.e., open and close) the intake passage internal end openings 23*b*, the cylinder head 4 is provided in the upper surface with stem insertion holes 67 adapted to attach the respective intake valves 18 thereto corresponding to the respective intake passage internal end openings 23*b*.

Similarly, in order to operate (i.e., open and close) the exhaust passage internal end openings 66*b*, the cylinder head 4 is provided in the upper end with stem insertion holes 68 adapted to attach the respective exhaust valves 19 thereto corresponding to the respective exhaust passage internal end openings 66*b*. An injector attachment portion 69 is provided at each of left and right external surfaces of the rear portion of the intake manifold portion 24.

An ignition plug insertion hole 70 is provided at each of two positions of the front portion of the cylinder head 4. The ignition plug insertion hole 70 extends between the exhaust passages 66 and between the stems of the exhaust valves 19, and terminates at the central portion of the combustion chamber 17.

Figure 9:
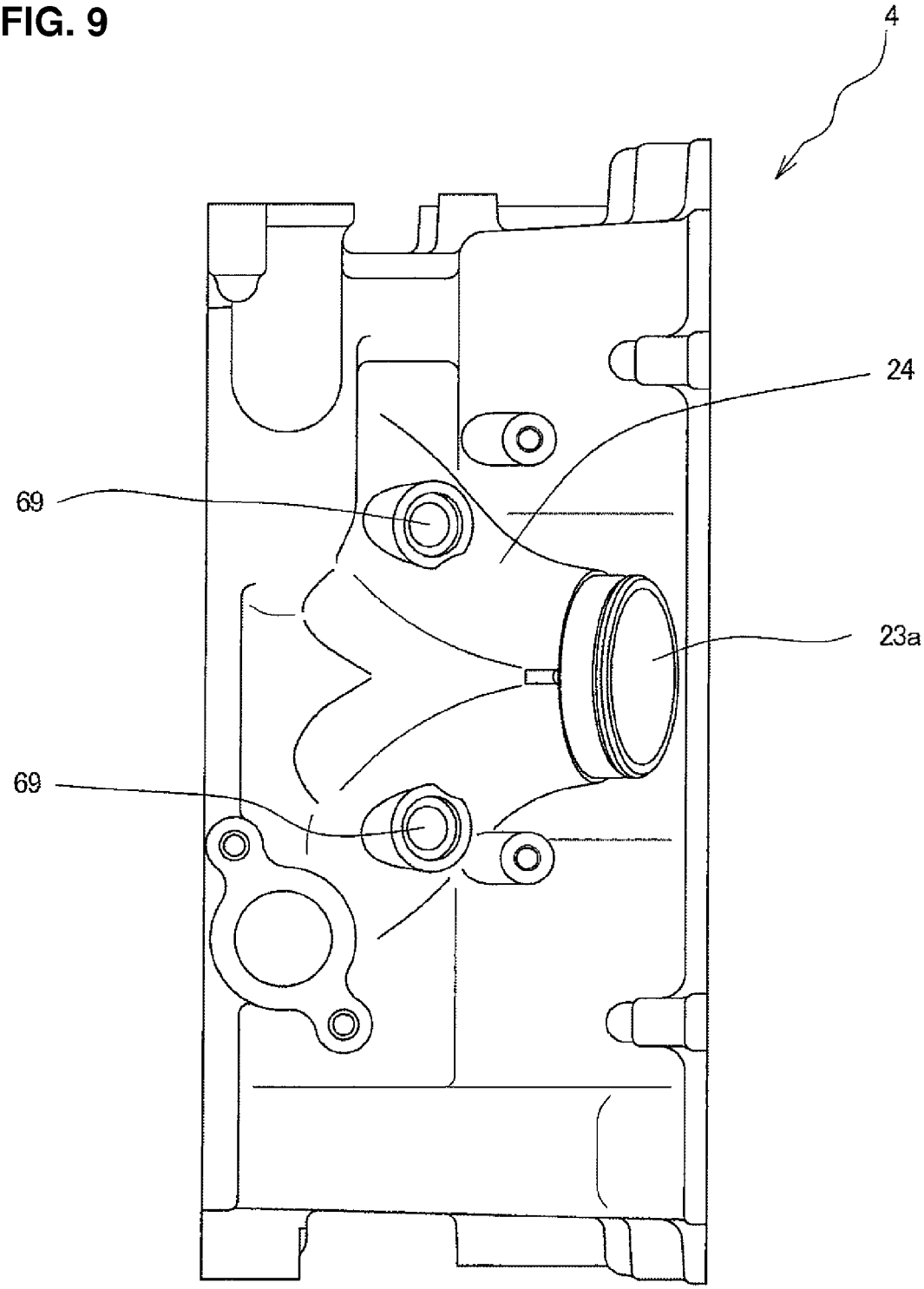
FIG. 9 is a rear view of the cylinder head.

FIG. 9 is a rear view of the cylinder head 4. The injector attachment portion 69 is provided at each of the left and right external surfaces of the intake manifold portion 24.

Figure 10:
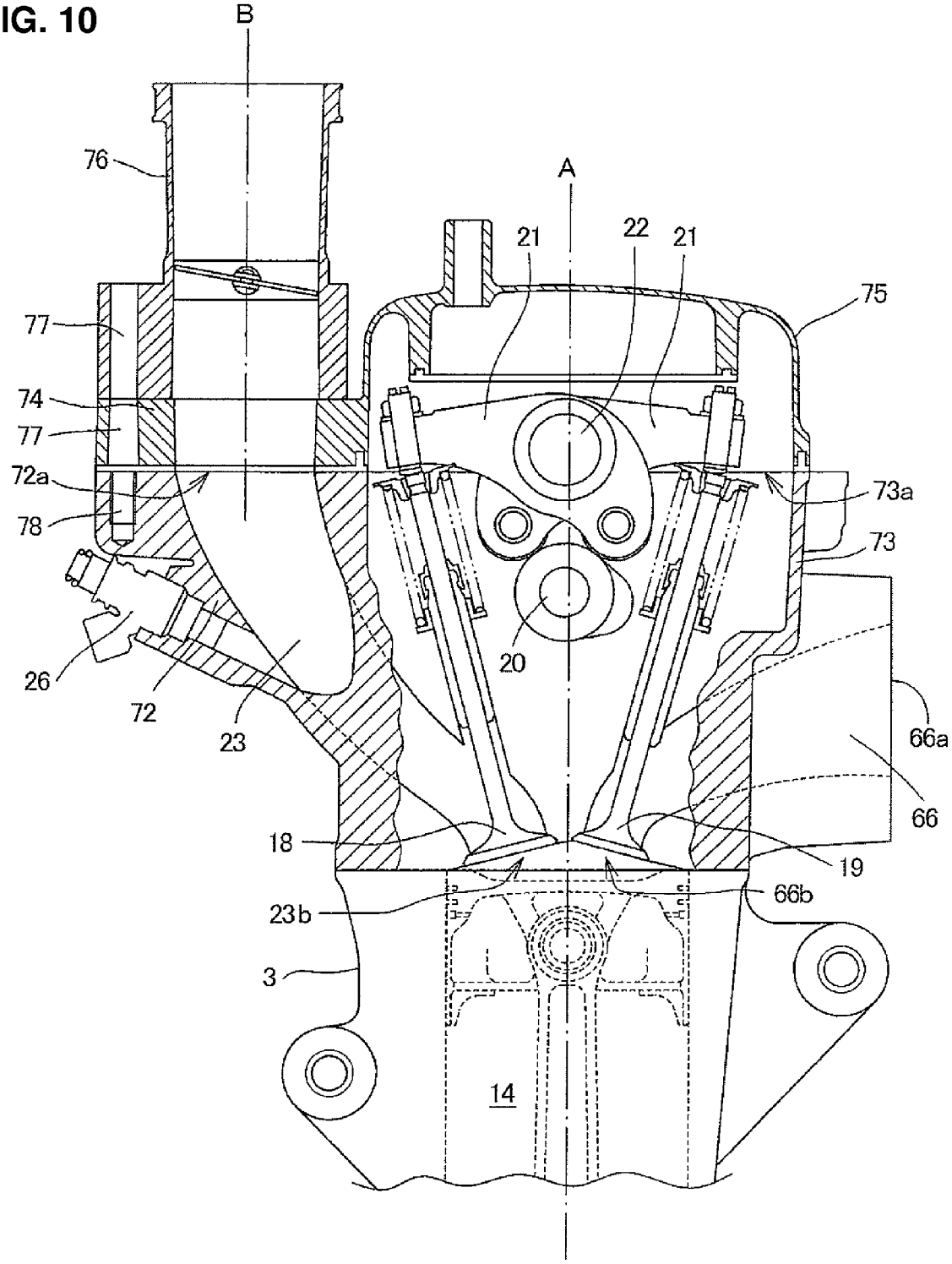
FIG. 10 is a longitudinal cross-sectional view of a cylinder head similar to FIG. 7, showing another illustrative embodiment of a mounting structure of an intake manifold portion.

FIG. 10 is a longitudinal cross-sectional view of an attachment structure of the intake manifold portion according to another illustrative embodiment of the present invention. Also, this embodiment is such that the cylinder central axis A is generally parallel to the centerline B of the throttle body extending direction of the intake passage 23.

In this embodiment, an inlet end face 72*a* of an intake manifold portion 72 is provided slightly higher than that of the previous example so as to be flush with an upper end face 73*a* of an cylinder head 73. An insulator 74 is configured integrally with the cylinder head cover 75.

A throttle body 76 is secured to the cylinder head 73 along with the insulator 74 by means of a bolt insertably screwed into a bolt insertion hole 77 and a screw hole 78 illustrated in the figure. Also in this example, the internal structure of the cylinder head 4 of the intake manifold portion 72 is generally the same as that illustrated in FIGS. 8 and 9. In addition, the injecting direction of the injector 26 generally faces the intake valve 18.

The embodiments, as described above in detail, provide the following effects.

(1) In the internal combustion engine 1 in which the cylinder central axis A is generally parallel to the centerline B of the throttle body extending in a direction of the intake passage 23, as illustrated in FIG. 7 or 10, the injector 26 and the intake passage 23 are made offset from each other widthwise as illustrated in FIG. 8. Thus, the injector 26 can be disposed at an appropriate position while preventing the interference between the injector 26 and the intake passage 23.

(2) As shown in FIG. 8, the upstream sides of the plurality of intake passages of the parallel two-cylinder internal combustion engine are brought into close to each other for integration. Thus, the intake system can be downsized without broadening widthwise.

(3) As shown in FIGS. 7-8, the plurality of intake manifold portions 24 are integrated on the upstream side so as to form the single intake passage and the single throttle body 25 is disposed at the integrating portion of the intake passages 23. Thus, the number of component and cost can be reduced compared with the case where a plurality of throttle bodies is arranged in a usual two-wheeled vehicle.

(4) As shown in FIGS. 7-8, the drive mechanism including the cam shaft drive sprocket 30 and the cam chain 31 as well as the cam shaft driven sprocket 29 and driving the intake and exhaust valves 18, 19 is disposed at the end portion of the cylinder-row. Thus, the intake passages 23 continuous with the cylinders 14 can be brought into close to each other to have a narrow width therebetween, thereby further achieving downsizing.

(5) As shown in FIG. 8, the branch passage 23*c* continuous with the intake valve 18 is formed inside the cylinder head 4. Thus, the branch passage 23*c* continuous with the intake valve 18 can be designed with ease without being influenced by the shape of the intake manifold portion 24.

(6) As shown in FIG. 8, an interval X between the intake valves 18 is made smaller than an interval Y between the exhaust valves 19. Thus, the intake passage 23 including the overall intake manifold portion 24 can be formed compactly, which contributes to the downsizing of the internal combustion engine.

(7) As shown in FIGS. 7-8 and 10, since the intake passage 23 is formed to be inclined generally linearly, the resistance of the passage can be suppressed to increase the output of the internal combustion engine.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. An intake passage structure for an internal combustion engine, said intake passage structure comprising:

a cylinder head having an intake valve guide passage formed therein for receiving a stem of an intake valve, the cylinder head comprising an intake manifold portion having an intake passage formed therein and an injector attachment portion formed therein in communication with said intake passage, said injector attachment portion situated on an opposite side of the intake passage from the intake valve guide passage; wherein said engine comprises:

a cylinder defining a cylinder center axis;

a fuel injector having a tip end disposed in the injector attachment portion; said cylinder head having an intake valve disposed therein; and a throttle body operatively attached to said intake manifold portion of said cylinder head; wherein:

a fuel delivery passage is formed in the intake manifold portion extending between the injector attachment portion and the intake passage;

said throttle body is attached to said intake manifold portion at a point of attachment, and said throttle body has a hollow bore formed therethrough which defines an extending direction of said intake passage;

said intake passage branches from said point of attachment of the throttle body to form a plurality of branch passages;

the cylinder central axis is arranged substantially parallel to said extending direction of said intake passage;

said injector tip end disposed in the injector attachment portion is oriented with an outlet thereof facing towards said intake valve of the cylinder head; and an upstream side of said intake passage is arranged offset relative to the injector attachment portion in a width direction of the internal combustion engine.

2. An intake passage structure for an internal combustion engine according to claim 1, further comprising a plurality of intake manifold portions, and a plurality of injectors;

wherein:

the internal combustion engine is a multi-cylinder internal combustion engine having a plurality of cylinders arranged in parallel;

each of the plurality of the intake manifold portions is respectively connected to a corresponding one of the cylinders; and each of the injectors is respectively disposed in a corresponding one of the intake manifold portions.

3. An intake passage structure for an internal combustion engine according to claim 2, wherein:

the plurality of intake manifold portions are integrated on an upstream side thereof thereby forming a single intake passage; and said throttle body is disposed in fluid communication with said single intake passage.

4. An intake passage structure for an internal combustion engine according to claim 2, wherein said engine comprises a drive mechanism for driving intake valves and exhaust valves disposed in the cylinder head; and wherein the internal combustion engine is arranged such that said drive mechanism is disposed at an end of a row of the cylinders.

5. An intake passage structure for an internal combustion engine according to claim 3, wherein each of the cylinders is provided with a plurality of exhaust valves;

wherein said engine comprises a drive mechanism for driving the intake valves and exhaust valves disposed in the cylinder head; and wherein the internal combustion engine is arranged such that said drive mechanism is disposed at an end of a row of the cylinders.

6. An intake passage structure for an internal combustion engine according to claim 3, wherein:

each of the cylinders is provided with a plurality of intake valves; and a branch passage arranged downstream of each of the intake manifold portions is connected with respective said intake valves arranged inside the cylinder head.

7. An intake passage structure for an internal combustion engine according to claim 5, wherein an arrangement-interval between a plurality of the intake valves is less than an arrangement interval between the exhaust valves for respective one of the cylinders.

8. An intake passage structure for an internal combustion engine according to claim 5, wherein each of the plurality of intake manifold portions has a branch passage formed therein; and wherein, when viewed in a side view, a portion of the intake passage from an intake passage inlet of the intake manifold portion to the branch passages is substantially linearly inclined.

9. An intake passage structure for an internal combustion engine according to claim 7, wherein, when viewed in a side view, a portion of the intake passage from an intake passage inlet of the intake manifold portion to the branch passage is substantially linearly inclined.

10. An internal combustion engine, comprising a pair of cylinders;

a cylinder head connected to said cylinders, said cylinder head comprising a plurality of intake valves and having a plurality of intake valve guide passages formed therein for respectively receiving stems of said intake valves;

an intake manifold portion formed integrally with said cylinder head;

a pair of injectors, each operatively associated with a respective one of said cylinders;

an intake passage formed in said intake manifold portion and comprising a plurality of branch passages, each of said branch passages being operatively associated with a respective one of said intake valves;

a pair of injector attachment portions formed in said intake manifold portion, each of said injector attachment portions receiving one of said injectors therein, said injector attachment portions situated on opposite sides of the respective intake passages from the intake valve guide passages;

wherein:

a cylinder central axis is arranged substantially parallel to an extending direction of said intake passage;

each of said injectors has a tip end which is oriented towards a respective one of said intake valves of the cylinder head;

a respective fuel delivery passage is formed in the intake manifold portion extending between each injector attachment portion and the intake passage; and an upstream side of the intake passage is arranged offset relative to the injector attachment portions in a width direction of the internal combustion engine.

11. An internal combustion engine according to claim 10, wherein:

said intake manifold portion comprises a plurality of branches, each connected to a corresponding one of the cylinders;

each of the injectors is respectively disposed in a corresponding one of the branches.

12. An internal combustion engine according to claim 11, further comprising a throttle body; wherein:

the plurality of branches are integrated on an upstream side thereof for forming said intake passage; and said throttle body is disposed in fluid communication with said intake passage.

13. An internal combustion engine according to claim 11, further comprising a drive mechanism for driving intake valves and exhaust valves; and wherein said drive mechanism is disposed at an end of a row of the cylinders.

14. An internal combustion engine according to claim 12, further comprising a drive mechanism for driving intake valves and exhaust valves; and wherein said drive mechanism for driving is disposed at an end of a row of the cylinders.

15. An internal combustion engine according to claim 13, wherein each of the cylinders is provided with a plurality of exhaust valves, and an arrangement-interval between a plurality of the intake valves is less than an arrangement interval between the exhaust valves.

16. An internal combustion engine according to claim 15, wherein when viewed in a side view, a portion of the intake passage from an intake passage inlet of the intake manifold portion to the branch passages is substantially linearly inclined.

17. A motorcycle comprising a body frame and an internal combustion engine operatively attached to said body frame, said engine comprising a plurality of cylinders;

a cylinder head connected to said cylinders, said cylinder head comprising a plurality of intake valves and a plurality of intake valve guide passages formed in said cylinder head for respectively receiving stems of said intake valves;

an intake manifold portion formed integrally with said cylinder head;

a plurality of injectors, each operatively associated with respective one of said cylinders;

an intake passage formed in said intake manifold portion and comprising a plurality of branch passages, each of said branch passages being operatively associated with a respective pair of said intake valves;

a plurality of injector attachment portions formed in said intake manifold portion, each of said injector attachment portions receiving one of said injectors therein, said injector attachment portions situated on opposite sides of the respective intake passages from the intake valve guide passages;

wherein:

a cylinder central axis is arranged substantially parallel to an extending direction of said intake passage;

each of said injectors is disposed in the intake manifold portion so as to be oriented towards a respective one of said intake valves of the cylinder head;

a respective fuel delivery passage is formed in the intake manifold portion extending between each injector attachment portion and the intake passage; and an upstream side of the intake passage is arranged offset relative to the injector attachment portions in a width direction of the internal combustion engine.

18. A vehicle according to claim 17, wherein:

said intake manifold portion comprises a plurality of branches, each connected to a corresponding one of the cylinders;

each of the injectors is disposed at a corresponding one of the branches.

19. A vehicle according to claim 18, further comprising a throttle body; wherein:

the plurality of branches are integrated on an upstream side thereof for forming said intake passage; and said throttle body is disposed in fluid communication with said intake passage.

20. A vehicle according to claim 18, wherein each of the cylinders is provided with a pair of exhaust valves, and a distance between a pair of the intake valves is less than a distance between the exhaust valves for each of the cylinders.

* * * * *